US007717439B2

(12) United States Patent
Chen

(10) Patent No.: US 7,717,439 B2
(45) Date of Patent: May 18, 2010

(54) SKATE DEVICE HAVING TURNABLE WHEELS

(76) Inventor: Shane Chen, 1821 NW. Eight Ave., Camas, WA (US) 98607

( * ) Notice: Subject to any disclaimer, the term of this patent is extended or adjusted under 35 U.S.C. 154(b) by 380 days.

(21) Appl. No.: 11/033,049

(22) Filed: Jan. 10, 2005

(65) Prior Publication Data

US 2005/0151332 A1 Jul. 14, 2005

Related U.S. Application Data

(60) Provisional application No. 60/535,393, filed on Jan. 9, 2004, provisional application No. 60/584,966, filed on Jul. 2, 2004.

(51) Int. Cl.
*A63C 17/06* (2006.01)

(52) U.S. Cl. ..... 280/11.221; 280/11.28; 280/11.27

(58) Field of Classification Search ..... 280/11.27, 280/11.28, 11.223, 11.221, 11.231
See application file for complete search history.

(56) References Cited

U.S. PATENT DOCUMENTS 2,719,724 A * 10/1955 Lundgren ..... 280/11.223
3,649,038 A * 3/1972 Huckenbeck ..... 280/11.28
4,138,127 A 2/1979 Kimmell et al.
4,382,605 A 5/1983 Hegna
5,082,300 A * 1/1992 Cucurullo ..... 280/11.224
5,192,088 A * 3/1993 Yu ..... 280/11.225
5,397,138 A * 3/1995 Mangelsdorf ..... 280/11.204
5,398,949 A * 3/1995 Tarng ..... 280/11.206
5,566,957 A * 10/1996 Ho ..... 280/11.223
5,709,396 A * 1/1998 Zorzi et al. ..... 280/11.28
5,732,957 A 3/1998 Yu
6,105,977 A * 8/2000 Bengtsson et al. ..... 280/11.231
6,161,846 A * 12/2000 Soderberg ..... 280/11.225
6,193,249 B1 * 2/2001 Buscaglia ..... 280/87.042
6,241,264 B1 6/2001 Page
6,419,248 B1 * 7/2002 Kay ..... 280/87.042
6,454,280 B1 * 9/2002 Longino ..... 280/11.28
6,644,673 B2 * 11/2003 Longino ..... 280/11.28
7,048,281 B2 * 5/2006 Longino ..... 280/11.221

* cited by examiner

*Primary Examiner*—Jeffrey J Restifo
(74) *Attorney, Agent, or Firm*—Steven J. Adamson

(57) ABSTRACT

A skate device that has one or more turnable wheels. In one group of embodiments, the turnable wheels may be linked such that when one wheel turns another wheel turns in a manner that facilitates turning. In another group of embodiments, the turnable wheels are not so linked. The skate device of the present invention may achieve turning from a point underneath the shoe or foot region of the skate, thus more closely approximately turning on ice skates. The skate device may have inline wheels and maybe relatively light-weight and compact.

17 Claims, 6 Drawing Sheets

SKATE DEVICE HAVING TURNABLE WHEELS

CROSS-REFERENCE TO RELATED APPLICATION(S)

This application claims the benefit of U.S. Provisional Application No. 60/535,393, filed Jan. 9, 2004, entitled "Steerable Skate Device" and having the same inventor as above. This application also claims the benefit of U.S. Provisional Application No. 60/584,966, filed Jul. 2, 2004, entitled "Skate Device Having Linked Turnable Wheels" and having the same inventor as above.

FIELD OF THE INVENTION

The present invention relates to wheel devices worn on a human foot for transportation. More specifically, the present invention relates to such devices that have a turnable wheel arrangement.

BACKGROUND OF THE INVENTION

The prior art includes various wheeled devices that are worn or otherwise attached to a human foot. Common examples include roller skates, in-line skates, roller skis and the like. Various other, less common, devices also exist.

Conventional roller skates have a wheel arrangement consisting of two paired wheels. This arrangement provides relative stability, but is undesirably bulky and heavy and offers limited steerability or turnability.

In-line skates tend to be faster and lighter than conventional roller skates, and they have grown in popularity. Turning an in-line skate is often achieved by (1) physically lifting the skate and placing it down in a new line-of-direction (sometimes stepping over the other skate) or (2) leaning in a desired direction and effectively "pulling" the skate in that direction. In the latter turn, the front wheel is pulled into the desired new direction and the skate effectively "slips" across the skating surface to achieve the turn. Some in-line skates are configured with center wheels that are lower than the front and back wheels. These "rocker" skates may be easier to turn yet are less stable.

Other in-line skates or roller ski type devices have been developed that offer some degree of turning, though the degree of turning tends to be limited and the turning mechanism bulky, heavy and/or complicated, etc. Examples include the devices found in U.S. Pat. Nos.: 6,241,264; 5,732,957; and 4,382,605; and European Patent No.: 355,897; among others.

These "turnable" skate devices typically turn in response to weight displacement, i.e., the user shifts his or her weight causing the wheels to turn. These devices do not operate by turning or pivoting the foot. It is a disadvantageous limitation of prior art wheeled skates that they do not provide a mechanism for turning the skate in response to turning of a user's foot.

Furthermore, devices such as those discussed in the '264 and '957 patents have a wheel located on one end that turns and a wheel on the other end that functions as the pivot point of the turn. Hence, the pivot point for the turn is located before or after the "foot coupling" region of the skate, and not under the skate as it is, for example, with ice skates.

It is desired to provide a wheeled skate that more closely approximates the ice skating experience, e.g., that turns in response to a user turning his or her foot. It is also desired to provide a wheeled skate that has an underfoot centered turning mechanism that facilitates turning in a rapid and efficient manner. Furthermore, it is desired to provide such features in a wheeled skate arrangement that is lightweight and non-bulky.

SUMMARY OF THE INVENTION

The present invention may be realized in several different embodiments and is not limited to the specific embodiments illustrated herein. The present invention seeks to overcome problems associate with the prior art and to meet unmet needs.

Among other attributes, the present invention provides a wheeled skate that achieves rapid and efficient turning. The pivot point for turning is preferably located under the skate and may be substantially centered to more closely approximate the ice skate experience, etc., among other benefits. The present invention also provides a skate that achieves these and related features with a lightweight, non-bulky skate configuration.

A skate in accordance with the present invention may have multiple turnable wheels that are coupled in a coordinated manner to achieve efficient turning. The range of turning of the wheels may differ based on distance from the turn pivot point. A linking or other suitable mechanism may be provided to facilitate the desired coordinated turning.

In addition, the present invention may include a wheel assembly for a skate or like device that is well designed for achieving both a strong driving force, i.e., pushing, and good turning abilities, as opposed to compromising one for the other as is often the case in a prior art wheeled skate. In the present invention, all or several of the wheels preferably provide (1) turning and (2) a good pushing base.

It should also be recognized that the present invention may also include a wheeled skate in which the wheels are not necessarily coordinated or linked mechanically, yet may turn in a coordinated fashion in use.

These and related objects of the present invention are achieved by use of a skate device having linked turnable wheels as described herein.

The attainment of the foregoing and related advantages and features of the invention should be more readily apparent to those skilled in the art, after review of the following more detailed description of the invention taken together with the drawings.

DETAILED DESCRIPTION

Figure 1:
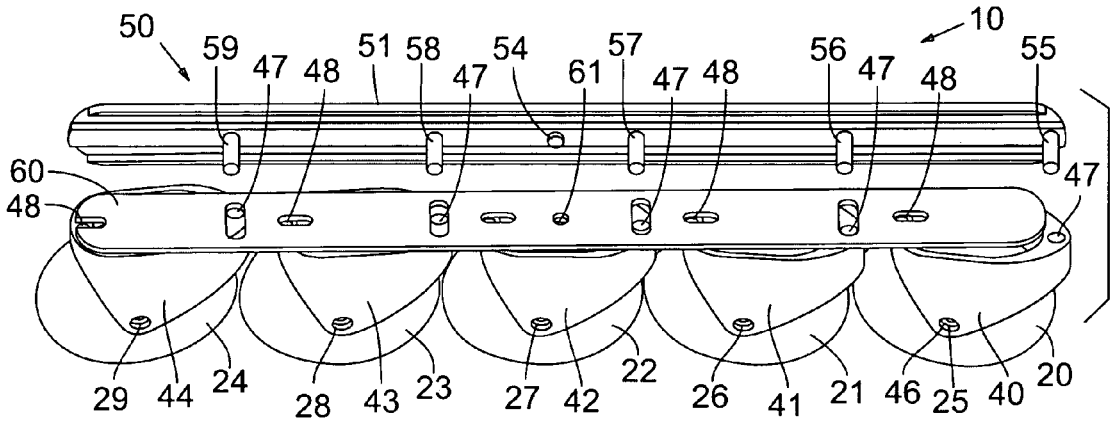
FIGS. 1-3 are a perspective break-away view, a top break-away view and a bottom view of one embodiment of a wheel assembly for a skate or like device in accordance with the present invention.
Figure 2:
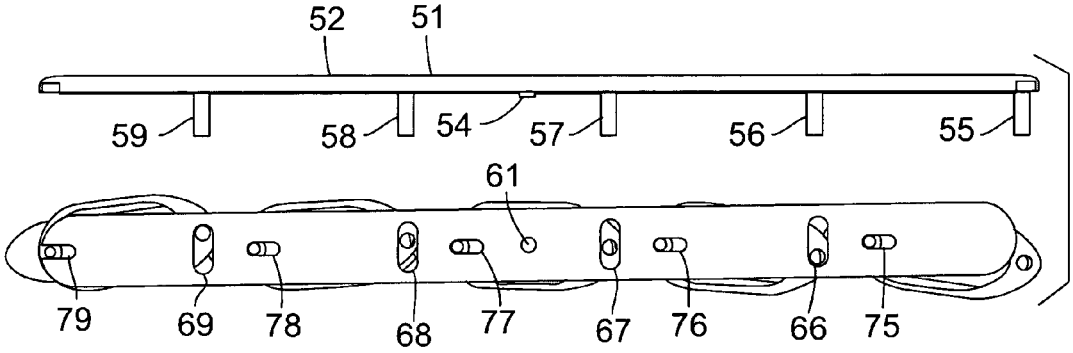
Figure 3:
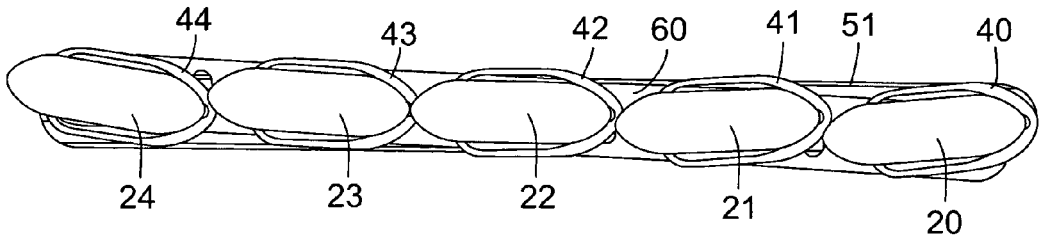

Referring to FIGS. 1-3, a perspective break-away view, a top break-away view and a bottom view of one embodiment of a wheel assembly 10 for a skate or like device in accordance with the present invention are respectively shown.

The embodiment of assembly 10 has five wheels 20-24, each with an independent axle 25-29. Suitable wheels and axles for in-line skates and like devices are known in the art and commercially available.

Assembly 10 also includes a frame or "chassis" 50 for mounting the wheels to the "foot coupling" region of a skate, regardless of the manner of coupling (shoe, straps, etc.). Frame 50 includes a top frame 51 and a link frame 60.

A top surface 52 of top frame 51 is preferably coupled to the foot coupling region of a skate device. The underside 53 of top frame 51 may include a plurality of linking protrusions 55-59 and a central pivot protrusion 54. While the linking protrusions are shown as being pins or rods, it should be recognized that any suitable shape (i.e., and shape that achieves linking to a wheel assembly) could be used.

The link frame 60 preferably has a geometric configuration that is complementary to top frame 50. Link frame 60 may include a plurality of slot 66-69 that each receive one of mounting pins 56-59. Note that since pin 55 in the embodiment of assembly 10 extends in front of link frame 60, a slot is not needed to accommodate this pin. A second or paired slot 75-79 is also provided in link frame 60 for each wheel. The frame pivot protrusion 54 is preferably mated with a complementary shaped recess (or some other suitably mated pivot arrangement is used—mated pivot arrangements are known in the art).

A wheel mounting frame or "cup" 40-44 preferably mounts each of the wheels 20-24 to frame 50. Each of cups 40-44 preferably includes a region 46 that receives a corresponding wheel axle 25-29 and has a front-end pin receiving structure 47 and a back-end position and support member 48. The cups may be similar to those found in shopping carts and the like that provide a forward pivot and let the wheel trail behind in the direction of travel.

In assembly 10, each of mounting pins 55-59 is inserted in its corresponding receiving structure 47 and provides the leading end positioning of its corresponding wheel. Each wheel is preferably turnable due to movement of pins 55-59 about a back pivot point defined by back-end member 48. Each of the back-end members 48 resides in its corresponding paired openings or slots 75-79.

Since each of mounting pins 55-59 is coupled to top frame 51 that pivots relative to link frame 60, the direction of turn of each wheel is accordingly influenced. Wheels with mounting pins forward of frame pivot point 54 will turn in one direction while wheels rearward of the frame pivot point will turn in the opposite direction, further increasing turnability. Moreover, the amount of turn achieved by each wheel is based on its distance from the pivot point which results in the wheels forming a coordinated "curve." The "curve" or collective line of travel defined by the coordinated or linked wheels creates a more continuous, appropriately directed and efficient (less friction, etc.) turning arrangement.

Referring specifically to FIG. 2, a top break-away view of assembly 10 is shown. The line of forward travel is from left to right on the page. When a user wants to turn towards the right, for example, he or she turns their foot in that direction which causes mounting pins 55-57 and their corresponding wheels 20-22 to move towards the right, and mounting pins 58-59 and their corresponding wheel 23-24 to move to the left. This effectively turns each of the wheels in a coordinated manner to make a right turn. The opposite occurs for a left turn.

Figure 4:
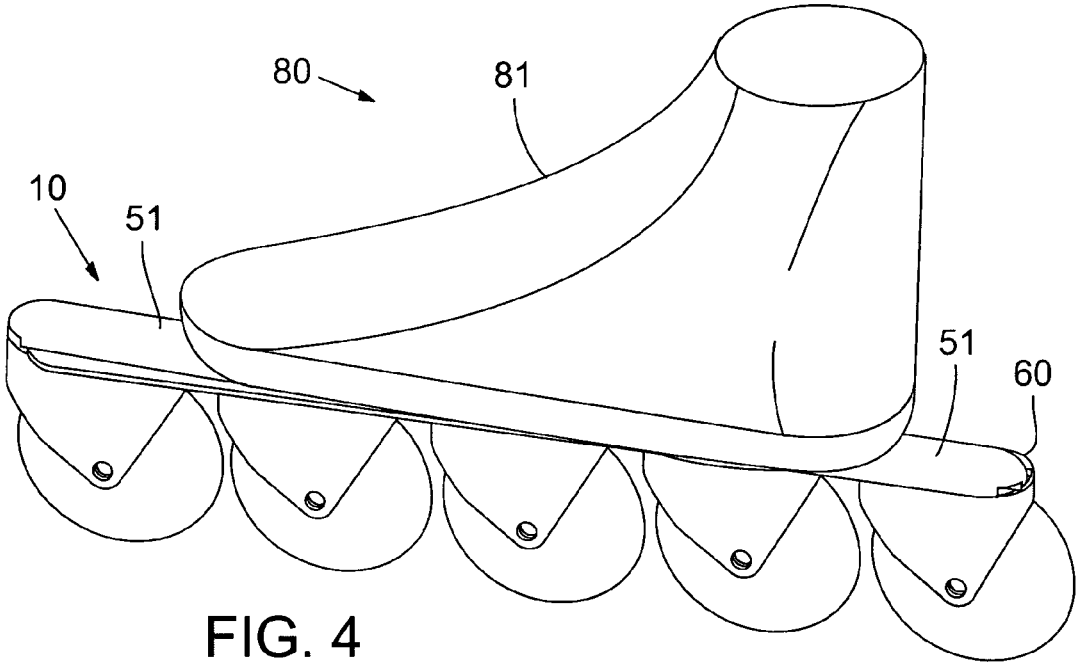
FIG. 4 is a perspective view of a skate including wheel assembly of FIGS. 1-3 in accordance with the present invention.

Referring to FIG. 4, a perspective view of a skate 80 including wheel assembly 10 of FIGS. 1-3 in accordance with the present invention is shown. Wheeled skate 80 includes a skate shoe 81 coupled to assembly 10. The skate shoe is mounted to top frame 51. In the arrangement illustrated in FIG. 4, the skate is making a right turn, notice that the top frame and link frame are not aligned and the wheels are each turned to some degree.

Figure 5:
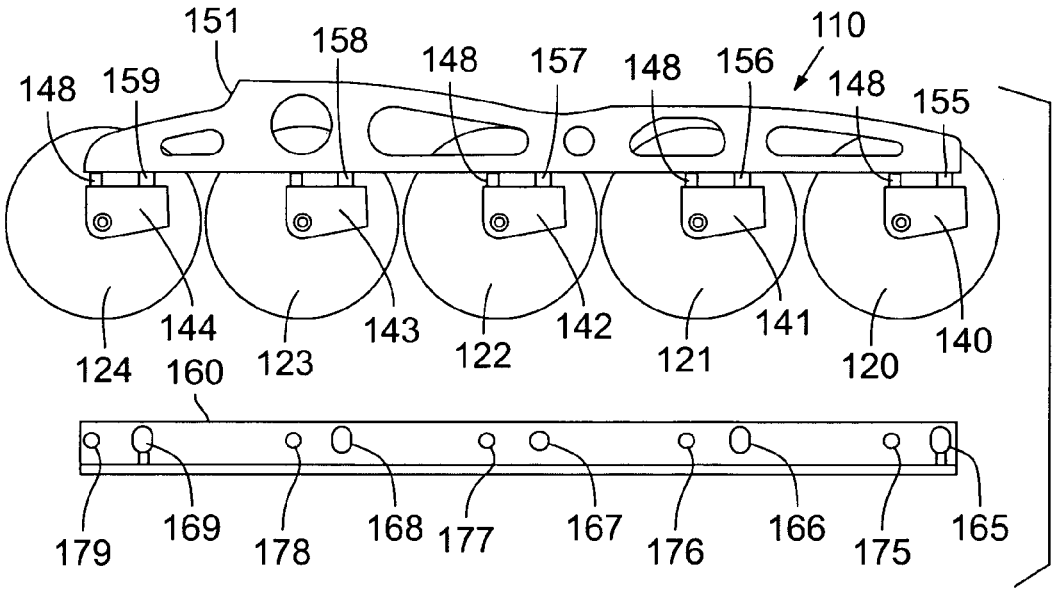
FIG. 5 is a break-away view of another embodiment of a wheeled skate assembly having coordinated wheel turning in accordance with the present invention.

Referring to FIG. 5, a break-away view of an other embodiment of a wheeled skate assembly 110 having coordinated wheel turning in accordance with the present invention is shown. Wheel assembly 110 includes a frame or chassis having a top frame 151 and a link frame 160 (the link frame is shown in a top plan view and the other components are shown in a side elevation view). Assembly 110 also includes a plurality of wheels 120-124 and corresponding wheel mounting members or "cups" 140-144 that mount the wheels to top frame 151. Assembly 110 operates in a manner similar to assembly 10 of FIGS. 1-3 and has similar components as manifested (in part) by related reference numbers, a 100s unit being added in FIG. 5 (and FIGS. 6-9).

Figure 6:
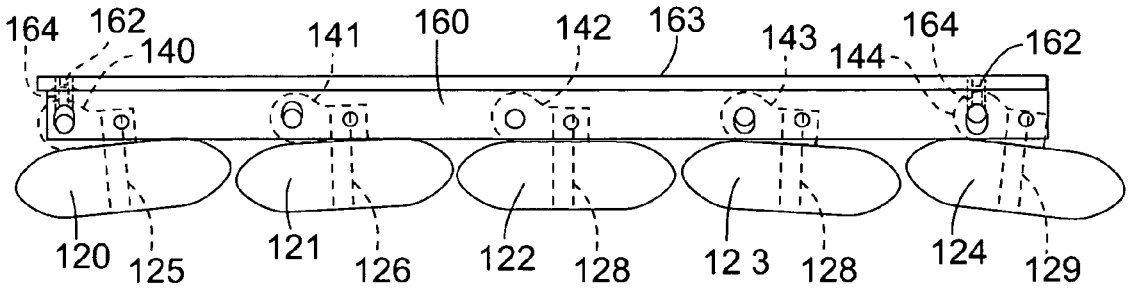
FIGS. 6-7 are two top plan views of assembly 110 of FIG. 5 are shown in accordance with the present invention. FIG. is a bottom plan view of assembly 110 of FIG. 5 in accordance with the present invention.
Figure 7:
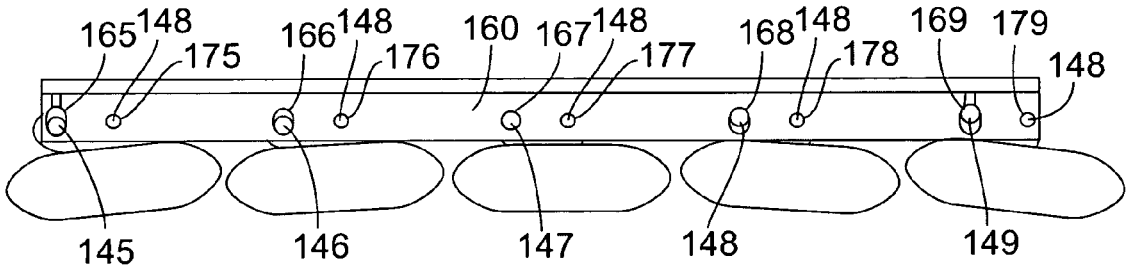
Figure 8:
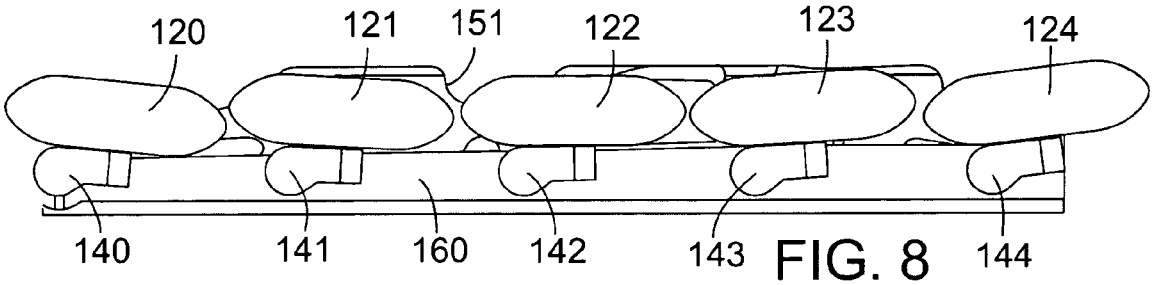

Referring to FIGS. 6-7, two top plan views of assembly 110, with and without cups 140-144 shown in phantom lines, and without top frame 50 are respectively shown in accordance with the present invention. Referring to FIG. 8, a bottom plan view of assembly 110 in accordance with the present invention is shown.

In the embodiments of FIGS. 6-8, the forward line of travel is from right to left across the page. In FIG. 5, it is to the right. Link frame 160 includes a plurality of opening 165-169 through which mounting pins 155-159 of top frame 151 couple to corresponding receiving structures 145-149 in cups 140-144. A second or paired opening 175-179 is also provided (per wheel) in link frame 160. A positing member 148 from each cup is preferably positioned in its corresponding paired opening 175-179. Positioning members 148 essentially provide the individual pivot points for each of the wheels.

FIG. 6 illustrates the position of axles 125-129 in each wheel, bias member fasteners 162, and a longitudinal support member 163. A spring or other bias member 164 may be provided at the front and/or back wheel (or otherwise located) to bias the link frame and hence the wheels back into a "non-turned" alignment with the top frame. This occurs in the absence of a turning force, for example, when a user lifts his or her foot.

FIG. 8 illustrates one embodiment of the relative position of top frame 151 over wheels 120-124. This perspective, among others, indicates that the link frame in assembly 110 is provided to the side of wheels 120-124 as opposed to above the wheel as in assembly 10 of FIGS. 1-3. It also illustrates that foot coupling region of top frame 151 is provided substantially over top of the wheels to provide a more "typical" skate experience.

FIGS. 6-8 illustrate a left-hand turn being executed.

While assembly 10 of FIGS. 1-4 has a separate or distinct frame pivot point 54, assembly 110 may be configured to have a frame pivot point 154 that is in common with one of the mounting pins, e.g., mounting pin 157 (see FIG. 5). A turn is achieved when a user turns his or her foot to the left or right. For a left hand turn, for example, the user turns his or her foot to the left which in turn moves mounting pins 155-156 (and their receiving structures 147) to the left. Mounting pin 157 does not move as it is the frame pivot point and mounting pins 158-159 move to the right (see, for example, FIGS. 6-7). To go straight after a turn, a user can turn their feet (foot) back towards straight or lift their foot to allow bias members 164 to move the top frame and link frame into straight forward alignment.

Figure 9:
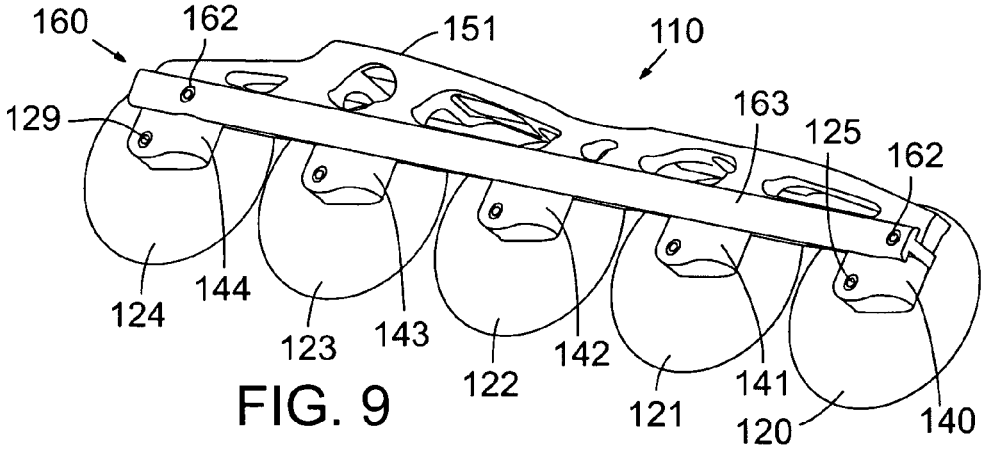
FIG. 9 is a perspective view of assembly 110 in accordance with the present invention.

Referring to FIG. 9, a perspective view of assembly 110 in accordance with the present invention is shown. In the perspective of FIG. 9, the wheels are substantially in a straight or non-turning arrangement (i.e., at rest in the absence of a turning force). Each of wheels 120-124 is coupled through an axle 125-129, respectively, to a forward pivot mounting cup 140-144. The cups are mounted through appropriately located openings 165-169 in link frame 160 to top frame 151 via mounting pins 155-159 and their corresponding receiving structures 147 (these elements are internal and, therefore, not shown in FIG. 9, see FIGS. 5-8).

Note that in assembly 10 and 110, mechanisms for rotatably, yet securely mounting a pin into a receiving structure, or providing another suitable pivotable coupling mechanism are known in the art.

While the skate assembly and skates described above are shown in five-wheeled embodiments it should be recognized that the present invention can be practiced in any arrangement have two or more wheels. In a preferred embodiment, the number of wheels is from 3 to 7.

Assemblies 10 and 110 may be made of aluminum, except for the wheels which are commercial available and of known materials. Alternatives for the aluminum material include other metals, alloys, plastics and any other rigid, durable and suitable lightweight material.

Non-Mechanically Linked Embodiments

Figure 10:
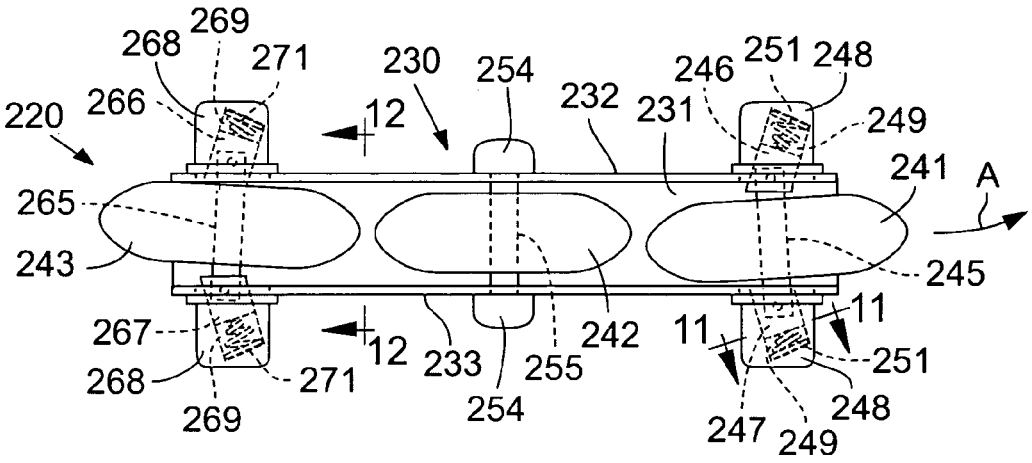
FIG. 10 is a top plan view of a wheeled assembly for a skate in accordance with the present invention.
Figure 12:
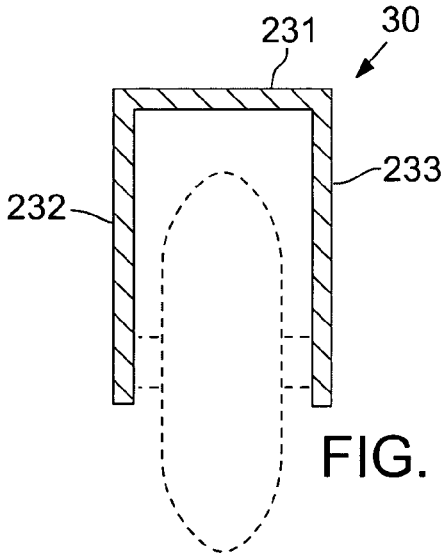
FIGS. 11 and 12 are sectional cross-section views of the embodiment of FIG. 10.
Figure 11:
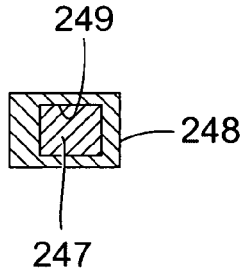

Referring to FIG. 10, a top plan view of a wheeled assembly 220 for a skate in accordance with the present invention is shown. FIG. 10 illustrates the wheeled assembly making a turn to the left. FIGS. 11 and 12 are sectional cross-section views of the embodiment of FIG. 10. The preferred line-of-direction of travel of assembly 220 is towards the top of the page, as indicated by arrow A.

Assembly 220 preferably includes a chassis or frame 230 that includes a top 231 and left and right sides 232, 233. As seen in FIG. 12, the chassis may generally have an up-side down square U-shape in cross-section and may be formed of an extruded or molded metal or hard plastic or the like. Top 231 is shown transparently to permit inspection of other components.

Assembly 220 may include a front, center and rear wheel 241-243, or have more or fewer wheels. Suitable wheels for wheeled skates, roller skis and like devices are known in the art. Front wheel 241 is preferably rotatably mounted to an axle 245. Ball-bearing based axle mounting arrangement are known in the art. Axle 245 may be coupled at a first end to a first movable axle plug 246 and at a second end to a second movable axle plug 247. Axle 245 is preferably pivotably coupled to these plugs. Axle caps 248 are fixedly coupled to the left and right chassis side walls and aligned with holes in the side walls through which front axle 245 may move. Each of the axle caps 248 includes a recess 249 that accommodates a complementary shaped plug 246, 247. Taken together recesses 249 preferably define a curve section with a common or near common radius and center point. Plugs 246, 247 and axle 245 preferably move within this curve section.

Springs or other bias mechanisms 251 preferably provide an equivalent force to both plug 246 and plug 247 forcing wheel 241 to be centered within chassis 230 in the absence of a turning force. Thus, while wheel 241 is shifted to the right and wheel 243 to the left for a left turn (as shown), wheels 241, 243 are centered in the absence of a turning force.

Center wheel 242 may be rotatably mounted to axle 255 using known wheel mounting techniques. In contrast to the ability of front axle 245 to move from side to side (within the defined curve section), center axle 255 is preferably fixedly mounted to chassis 230. End caps 254 may secure axle 255 to chassis 230.

Rear wheel 243 is preferably rotatably mounted to axle 265, which is turn may be pivotally mounted to plugs 266, 267 which move within recesses 269 of axle caps 268. Axle 265, plugs 266, 267, caps 268, recesses 269 and springs 271 function in a similar manner to their counterparts at front wheel 241.

The configuration of wheeled assembly 220 permits independent movement of the front and rear wheels 241, 243 relative to chassis 230. This permits operator directed turning of the skate. Turning is generally achieved as follows. A user, wanting to turn, turns his or her foot in the desired direction of travel, effectively and preferably pivoting the foot near a center point thereof to attain the new direction. This causes the chassis to pivot in a similar manner (about center wheel 242) which in turn causes the biased front and rear wheels to rotate within their respective curve section as appropriate.

In the instant example, a left turn, a user's toes move toward the left and the user's heal towards the right. The front and rear wheel move towards the positions shown in FIG. 10. The front and rear wheels return to a centered position when the user turns his or her foot back toward a center position or lifts his or her foot such that spring 251, 271 respectively push wheels 241, 243 back towards center.

The user's foot effectively pivots "turns" or pivots"at or near the center point of the user's skate in much the same way a figure or hockey skate pivots on ice.

FIG. 11 illustrates plug 247 within complementary shaped recess 249 in axle cap 248. Plug 246 is similarly configured within its axle cap. The plugs and recessed axle caps are preferably configured of materials and in such a manner that the plugs move with low-friction within the recesses while bearing the weight of a user. Suitable materials for these parts include hard plastics, such as nylon, metals, and other hard materials on which a low friction surface can be formed.

Springs 251, 271 are shown as coil springs, but leaf springs, compression springs, compressive materials and any other suitable bias mechanism, many of which are known, may be used.

FIG. 12 illustrates a latitudinal cross-sectional view of one embodiment of chassis 230 with a wheel drawing in phantom to provide perspective.

Figure 13:
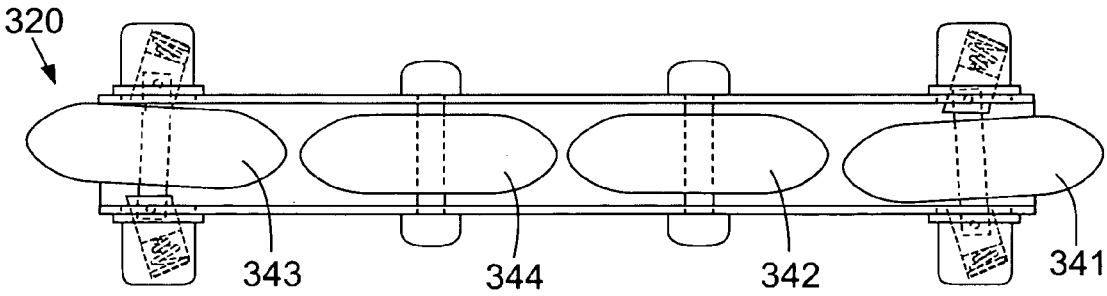
FIG. 13 is a plan view of a four wheel version of the wheeled assembly of FIG. 10.

Referring to FIG. 13, a four wheel version of the wheeled assembly of FIG. 10. Assembly 220 of FIG. 13 includes a front wheel 341 and a rear wheel 343 that are configured in a manner similar to front wheel 341 and rear wheel 343 of FIG. 10, respectively. Center wheels 342 and 344 may be configured in a manner similar to center wheel 342 of FIG. 10. Note that center wheels 342, 344 may be formed in a manner similar to wheels 341, 343 of FIG. 10, though with a range of movement (in their curved section) that is less than that of the front and rear wheels 341, 343. The pivot point of the four wheeled assembly 320 is preferably located between the two center wheels. Assembly 320 otherwise functions in a manner similar to assembly 220 of FIG. 10 (which has a preferred pivot point near or at center wheel 242).

Figure 14:
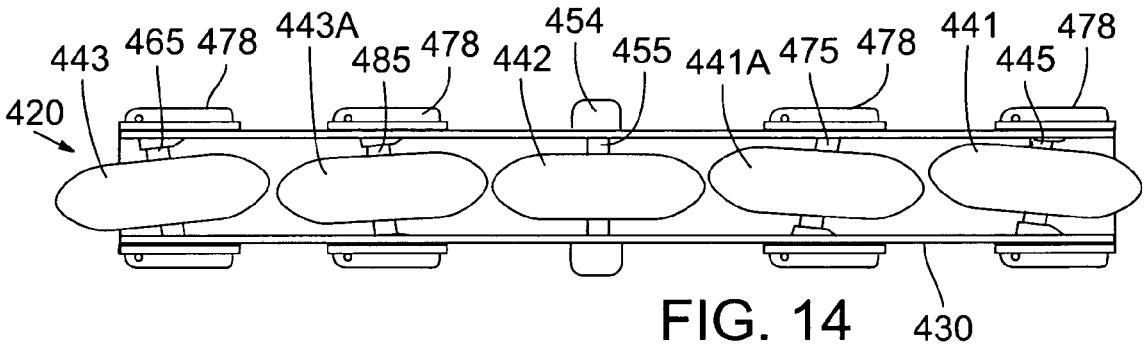
FIG. 14 is a top plan view of a wheeled assembly for a skate in accordance with the present invention.

Referring to FIG. 14, a top plan view of a wheeled assembly 420 for a skate in accordance with the present invention is shown. The assembly 420 of FIG. 14 includes five wheels 441, 441A, 443, 443A and 443, rotatably mounted to axles 445, 475, 455, 485 and 465, respectively. FIG. 14 illustrates the assembly making a right hand turn with the line of travel being upward on the drawing sheet.

Wheel 442 may be fixedly (non-turnably) mounted to chassis 430 in much that same manner as wheel 242 of FIG. 10, while the other wheels may be mounted with mechanisms that support turnability. In the present embodiment, front wheel 241 and rear wheel 243 function similar to wheels 241 and 243 of FIG. 10, respectively, yet the mechanism that provides the turning function is different. That mechanism is described below with reference to FIG. 15. Wheel 441A has a similar function and mechanism as wheel 441 and wheel 443A has a similar function and mechanism as wheel 443, yet wheels 441A and 443A preferably have a reduced range of turning than their accompanying front or rear wheel—such that each turnable wheel has a range of turning and radius that is appropriate given its distance from the pivot point of assembly 420 which is at or near center wheel 442. The turnable wheels are mounted with end caps 478, while center wheel 442 is mounted with end caps 454.

Figure 15:
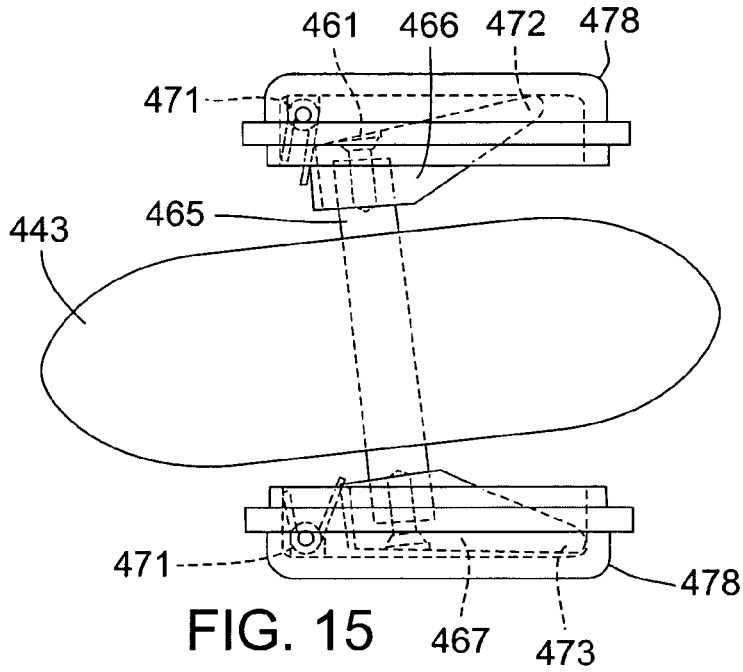
FIG. 15 illustrates in more detail a rear wheel 243 from the assembly of FIG. 14.

Referring to FIG. 15, rear wheel 443 is shown in more detail. Wheel 443 is coupled to axle 465 which is in turn connect with pins 461 to plugs 466 and 467. Each of these plugs is movable mounted within the interior recess of mounting end cap 478. At rest (i.e., no turning force), springs 471 bias each plug so that its forward tip 472, 473, respectively, is pushed forward (upward in FIG. 15) till it contacts the front wall of the end cap 478. In FIG. 15, tip 473 of plug 447 is shown in this position. In the presence of a turning force, axle 465 rocks backward on one side in response to a user directed pivot of the skate (the foot in the skate). In the present example, a right turn, the user's heal is shifted to the left as the foot pivots right, causing axle 465 and wheel 443 to "rock" or "move" into the positions shown in FIG. 15. When the user lifts his or her foot or reduces the turning force, the bias of springs 471 re-centers the wheel.

Figure 16:
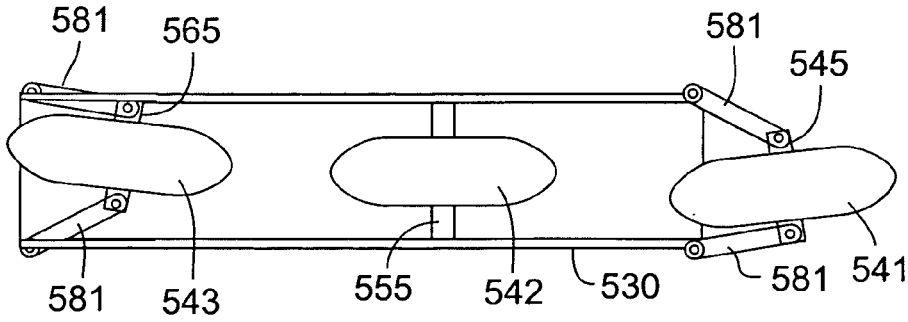
FIG. 16 is another embodiment of a steerable assembly for a skate in accordance with the present invention.

Referring to FIG. 16, another embodiment of a steerable assembly 520 for a skate in accordance with the present invention is shown. This assembly may include a chassis 530 to which are rotatably mounted wheels 541-543. Front wheels 541 and rear wheel 543 are mounted to axles 545, 565 that are held by biased arm members 581. Center wheel 542 is rotatably mounted to axle 555 which is fixedly mounted to chassis 530.

Arm members 581, in the absence of a turning force, are preferably symmetrically disposed about the center line of the chassis. In the presence of a turning force (a foot pivot force), arm members permit wheels 541 and 543 to move (rather "rock") through a curve or arc section until the turning force is withdrawn. A left turn force is exerted in the example illustrated in FIG. 16. It should be recognized that while members 581 are shown as each being coupled at two pivotally connected places (one to the axle and the other to the frame), the members may be formed integrally with a plastic or like frame and be configured such that they move slightly as an inherent property of the material in which they are made, pivotally coupling to the axle but simply movably extending from the frame with which they are formed integrally.

Figure 17:
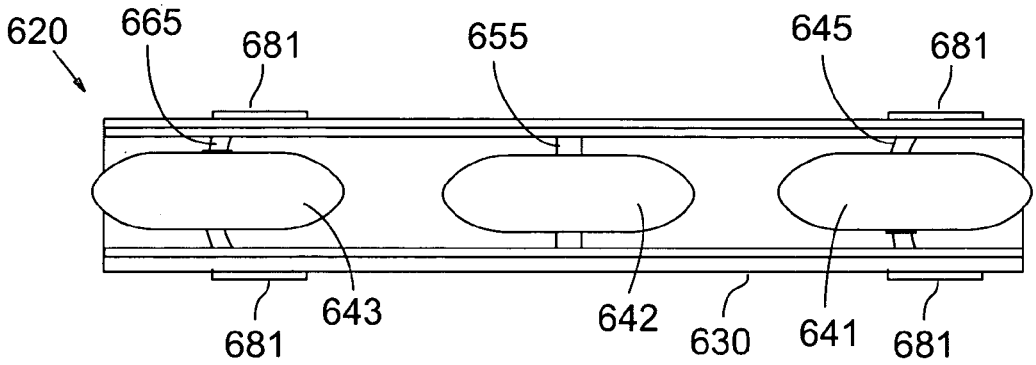
FIGS. 17 and 18 are top plan views of another embodiment of a steerable assembly for a skate in accordance with the present invention.
Figure 18:
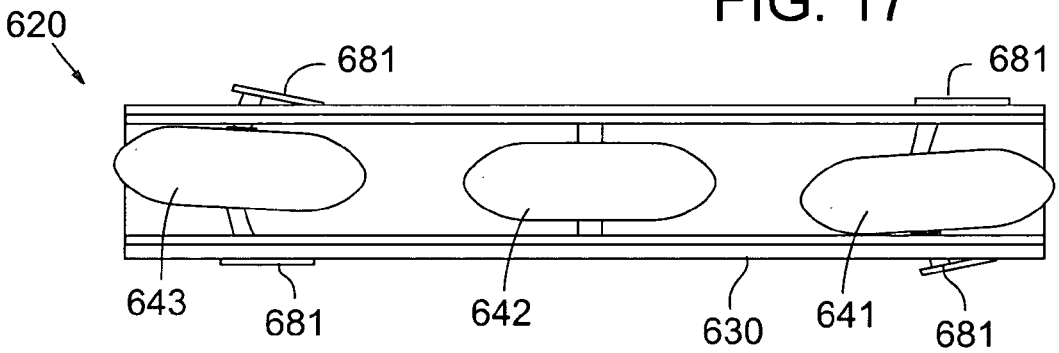

Referring to FIGS. 17 and 18, top plan views of an other embodiment of a steerable assembly 620 for a skate in accordance with the present invention are shown. Assembly 620 may include a chassis 630 to which are mounted turnable front and rear wheels 641 and 643 and a non-turnable center 642 (about which the assembly preferably pivots during a turn). While center axle 655 is fixedly mounted, front and rear axles 645 and 665, respectively, have a curved shaped and are moveably mounted. Moveable axles 6456 fit into holes in the side walls of chassis 630 and are centered by bias members 681. In the absence of a turning force, members 681 center wheels 641, 643 (see FIG. 17). In the presence of a turning force, the axles may move as appropriate. Movement for a left turn is shown in FIG. 18. A right turn would be the opposite. Assembly 620 is operated in the same manner as discussed for the other assemblies herein (i.e., turning or rather pivoting the foot attached to the skate).

Figure 19:
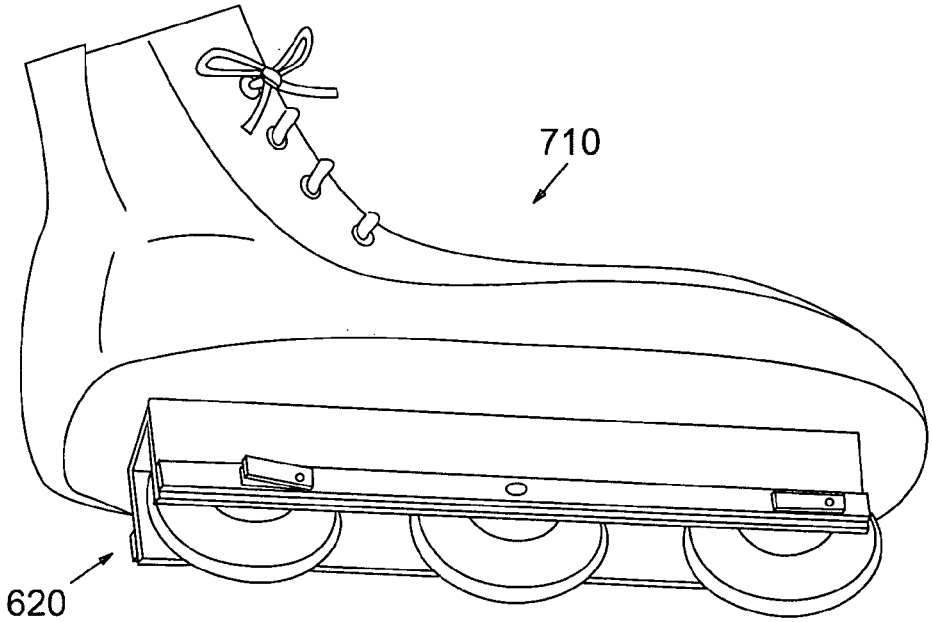
FIG. 19 is a bottom perspective view of a skate or other wheeled device that incorporates the assembly of FIGS. 17 and 18 in accordance with the present invention.

Referring to FIG. 19, a bottom perspective view of a skate or other wheeled device 710 in accordance with the present invention is shown. While device 710 includes assembly 720 of FIGS. 17 and 18, any of the assemblies described herein or other assemblies within the teaching and scope of the present invention could be used in place of assembly 620.

Note that while one assembly is shown on device 710, it is possible to provide two assemblies (preferably in parallel) to provide increase stability, for example, for a toddler.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A wheeled skate device, comprising:

a substantially linearly disposed frame member having a foot placement region and a longitudinal axis;

at least a first wheel forward located, a second wheel rearward located and a third wheel positioned between said first and second wheels, said first, second and third wheels being coupled to said frame member and each wheel having a vertical center;

wherein in response to a user turning his or her foot during use, said first wheel turns in a first direction and said second wheel turns in a second direction, different from said first direction, and said third wheel- turns, if at all, less than said first or second wheel; and wherein the distance between the vertical center of the third wheel and the longitudinal axis during a turn is less than the distance between the vertical center of the first or second wheel and the longitudinal axis, and wherein the distance of the vertical center of the first and second wheels from the longitudinal axis increases as the degree of turning increases.

2. The device of claim 1, configured such that a center of turning of said device is under the foot placement region.

3. The device of claim 1, further comprising one mounting mechanism per turnable wheel for mounting that turnable wheel to said frame member.

4. The device of claim 1, further comprising a substantially rigid link member coupling said first and second wheels to provide coordinated turning of said two wheels.

5. The device of claim 1, wherein said third wheel is non-turning.

6. The device of claim 1, further comprising a fourth wheel that is turnable and provided between said third wheel and said first or second wheels, said fourth wheel turning proportionally less than said first or second wheel based its distance from the center of turning of said device.

7. A wheeled skate device, comprising:

a substantially linearly disposed frame member having a foot placement region;

at least a first wheel, a second wheel and a third wheel singularly coupled to said frame member and configured substantially inline, said third wheel being positioned between said first and second wheels;

wherein in response to a user turning his or her foot, said first wheel turns in a first direction and said second wheel turns in second direction, different from said first direction; and a link member that is substantially rigid along a longitudinal axis and is coupled to at least the first and second wheels to provide coordinated turning of these two wheels; and wherein said frame member and said link member are coupled through a pivot.

8. The device of claim 7, further comprising a plurality of mounting mechanisms, one for each of said turnable wheels.

9. The device of claim 7, wherein said third wheel is non-turning.

10. The device of claim 7 configured such that a center of turning of said device is under the foot placement region.

11. The device of claim 7, wherein said third wheel is turnable.

12. A skate device, comprising:

a substantially linearly disposed frame member having a foot placement region;

at least a first wheel, a second wheel and a third wheel coupled to said frame and configured substantially inline, said third wheel being positioned between said first and second wheels; and a link member coupling said first wheel and said second wheel to provide coordinated turning of these two wheels;

wherein in response to a user turning his or her foot, said first wheel turns in a first direction and said second wheel turns in a second direction, different from said first direction; and wherein said frame member and said link member are coupled through a pivot.

13. The device of claim 12, wherein said first and second wheels are singularly coupled to said frame member and configured substantially inline.

14. The device of claim 12, configured such that a center of turning of said device is under the foot placement region.

15. The device of claim 12, wherein said third wheel is turnable and turns proportionally less than said first or second wheel based on its distance from the center of turning of said device.

16. The device of claim 12, wherein said third wheel is non-turning.

17. The device of claim 12, wherein said third wheel is turnable and said link member provides coordinated turning between said first, second and third wheels.

* * * * *